US007178265B2

(12) United States Patent
Ford

(10) Patent No.: US 7,178,265 B2
(45) Date of Patent: Feb. 20, 2007

(54) AMBIENT AIR CLOTHES DRYER

(76) Inventor: Larry W. Ford, 958 Crazyhorse Way, Las Vegas, NV (US) 89110

( * ) Notice: Subject to any disclaimer, the term of this patent is extended or adjusted under 35 U.S.C. 154(b) by 0 days.

(21) Appl. No.: 11/062,659

(22) Filed: Feb. 23, 2005

(65) Prior Publication Data

US 2006/0107548 A1 May 25, 2006

Related U.S. Application Data

(60) Provisional application No. 60/630,165, filed on Nov. 22, 2004.

(51) Int. Cl.
*F26B 11/02* (2006.01)

(52) U.S. Cl. ..... 34/601

(58) Field of Classification Search ..... 34/260, 34/265, 312, 318, 320, 322, 425, 452, 499, 34/520, 594, 58, 63, 108, 130, 609, 139, 34/135, 136, 137, 601
See application file for complete search history.

(56) References Cited

U.S. PATENT DOCUMENTS

| | | | | |
|---|---|---|---|---|
| 1,284,007 A | | 11/1918 | Whitcomb | |
| 2,552,855 A | * | 5/1951 | Johnston | 366/232 |
| 3,457,656 A | | 7/1969 | Fox | |
| 3,483,632 A | * | 12/1969 | Triplett | 34/601 |
| 4,236,322 A | | 12/1980 | Hastings | |
| 4,412,390 A | | 11/1983 | Grant | |
| 4,514,914 A | | 5/1985 | Kitzmiller | |
| 4,702,018 A | | 10/1987 | Hastings | |
| 4,742,624 A | | 5/1988 | Grant | |
| 5,809,663 A | | 9/1998 | Perque | |
| 6,449,876 B1 | * | 9/2002 | Pursell | 34/595 |
| 6,931,760 B2 | * | 8/2005 | Yang | 34/491 |

FOREIGN PATENT DOCUMENTS

WO WO 02-090853 11/2002

OTHER PUBLICATIONS

Website, "cetsolar.com/spinx.htm", Spin-X centrifugal clothes dryer, two pages, printed Dec. 22, 2004.

* cited by examiner

*Primary Examiner*—Kenneth Rinehart
(74) *Attorney, Agent, or Firm*—Richard C. Litman

(57) ABSTRACT

The ambient air clothes dryer is an automated device providing axial flow of unheated ambient air through the dryer drum. The dryer may include different drum drive systems, timer and/or humidity detector controls, and a configuration utilizing a separate, portable fan for temporary, removable installation with the dryer housing to provide airflow through the drum. The ambient air dryer greatly reduces energy requirements for drying laundry when compared to conventional heated air dryers, and is quite effective in warm and/or dry climates. The ambient air dryer is portable and may be used indoors or outdoors. The device may be configured to use twelve-volt power from a motor vehicle for use in camping. When used indoors, the device may be placed with a heat source (heat register, etc.) to draw warm air through the drum while humidifying the air as it passes through damp laundry in the drum.

4 Claims, 5 Drawing Sheets

AMBIENT AIR CLOTHES DRYER

REFERENCE TO RELATED PATENT APPLICATION

This application claims the benefit of U.S. Provisional Patent Application Ser. No. 60/630,165, filed on Nov. 22, 2004.

BACKGROUND OF THE INVENTION

1. Field of the Invention

The present invention relates to automated devices for drying clothing and laundry. More specifically, the ambient air clothes dryer is a clothes dryer devoid of any dedicated heating elements or systems for heating the air.

2. Description of the Related Art

The development of the automatic clothes dryer has been a great labor saving device for most households and, along with the automatic washing machine, has served to facilitate the commercial laundry industry as well. Automatic clothes dryers were initially developed when energy costs were relatively low, and accordingly make use of gas or electrical heat to accelerate the drying process. As a byproduct of the heat developed, the home or other structure is also heated, even though most of the heat is ducted to the exterior of the structure during dryer operation. Still, the residual heat output into the structure was not considered to be particularly undesirable, even in warmer conditions, as the energy costs required to operate air conditioning systems were much lower in the past.

However, with ever-increasing energy costs, the cost of operation of such conventional dryers has climbed considerably over the years, and even more so when the energy required to dissipate their heat output is considered. While conventional hot air clothes dryers have their place in very damp and/or cool climates, the heat they develop is an undesirable side effect of the drying operation in many parts of the country during much of the year. The alternative of the conventional clothes line is not suitable for many households due to the frequency of damp weather in many areas and seasons, and the time and labor required to tediously pin up each garment or article to the line and remove them, perhaps several hours later, when they are dry.

While some clothes dryers have been developed in the past that do not provide a source of heat during the drying operation, such dryers have not been found entirely satisfactory. Thus, an ambient air clothes dryer solving the aforementioned problems is desired.

SUMMARY OF THE INVENTION

The ambient air clothes dryer is an automated device including a motor-powered rotating drum having a fan providing axial airflow through the drum. No dedicated heating element is provided. Some embodiments include a fan motor and an additional motor to rotate the drum, while other embodiments utilize a belt or other drive from the fan output shaft to drive a jackshaft to rotate the drum, thereby saving weight, complexity, and energy. Yet another embodiment may be devoid of any fan or air circulation device, and may include only a motor to rotate the drum. This embodiment includes means for the removable and temporary installation of a conventional "box fan" therewith, to provide the air circulation required. Any or all of the embodiments may include a timer and/or humidity detector to provide for automatic shutoff of the fan and drum when the laundry is dry and/or a predetermined time has been reached.

The portability of the device allows it to be used indoors or outdoors, as desired. The device may take advantage of ambient heating sources within the home or other structure if so desired, e.g., a heat register, radiator, Franklin stove, etc., to provide some heating of the air, which then passes through the dryer drum. This also provides the beneficial effect of humidifying the air within the structure in colder weather. The device may be constructed to utilize twelve-volt power, if so desired, for use in camping when an automotive electrical system is available.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an ambient air clothes or laundry dryer, in which unheated air at ambient temperature is blown through the dryer drum to dry clothing therein. While some slight amount of heat may be provided from the fan motor, the present ambient air dryer device does not include any form of dedicated, specific heating apparatus, as is found in conventional clothes dryers.

Figure 1:
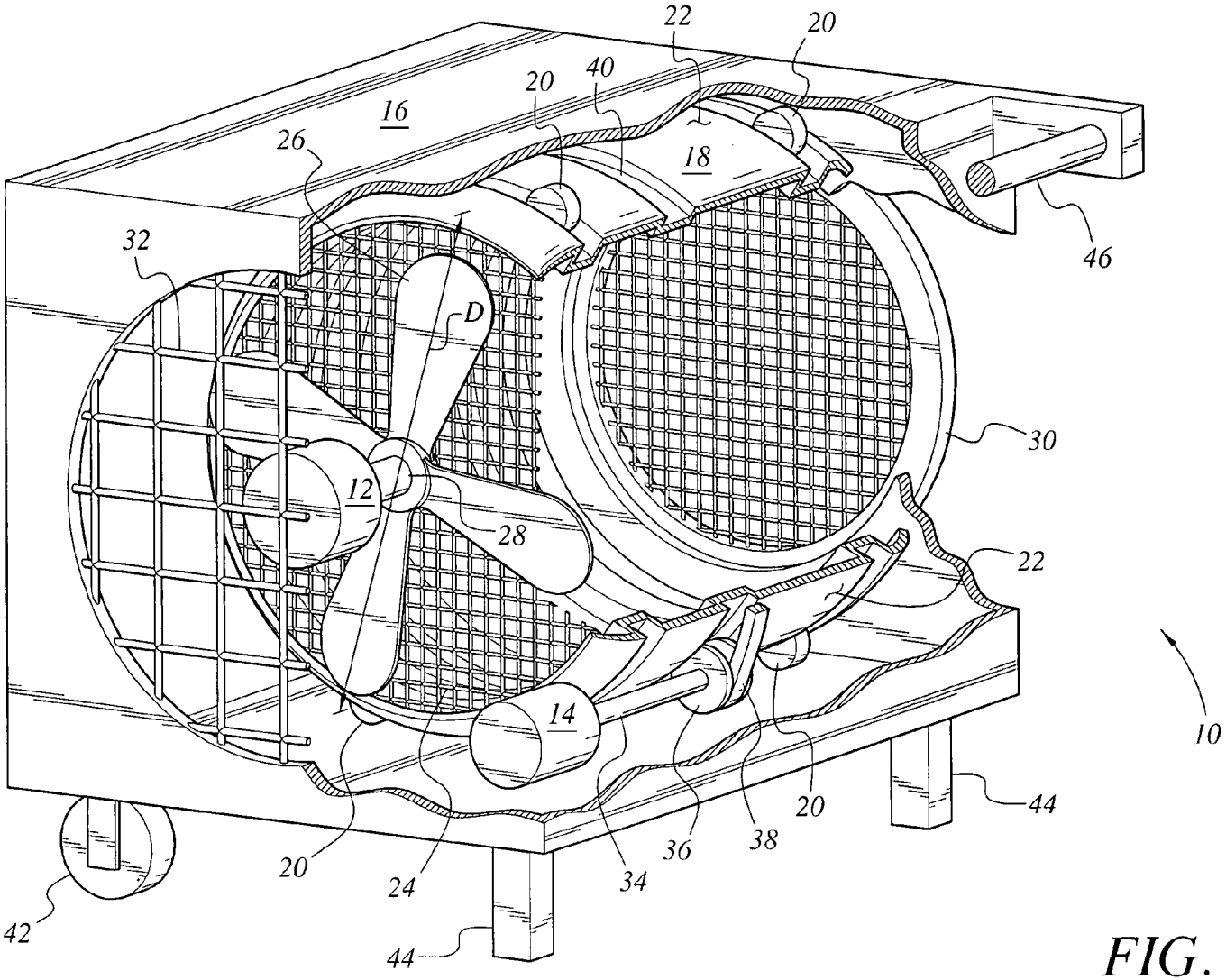
FIG. 1 is a partially broken away perspective view of a first embodiment of an ambient air clothes dryer according to the present invention, showing various details thereof.

FIG. 1 of the drawings illustrates a first embodiment of the present dryer 10, in which a separate fan motor 12 and drum rotation motor 14 are employed. The dryer 10 includes a housing or shell 16 having a hollow dryer drum 18 therein. The drum 18 rotates within the housing 16, and is supported by drum support wheels 20 or other mechanism installed internally within the housing 16. The dryer drum 18 has an impervious, generally cylindrical wall 22 having a diameter D. A screened airflow inlet end 24 is positioned adjacent the fan motor 12 with its fan 26 and fan drive shaft 28, with a screened airflow outlet end door 30 located opposite the inlet end 24 of the drum 18. The two screened ends 24 and 30 are preferably of a sufficiently fine mesh or gauge as to preclude the passage of small articles (e.g., loose change, buttons, etc.) therethrough, and have diameters closely approaching the diameter D of the dryer drum 18. The screen of the outlet door 30 may have a mesh or gauge sufficiently fine to serve as a lint trap for the dryer.

The fan drive motor 12 with its fan drive shaft 28 and circular, rotary fan 26 are concentrically disposed externally to the airflow inlet end 24 of the dryer drum 18, but within the housing 16. The fan 26 preferably has a diameter closely approaching the diameter D of the dryer drum 18 and the inlet and outlet ends 24 and 30 of the drum 18, in order to maximize airflow through the drum 18. A fan guard 32 is preferably installed across the air inlet opening of the dryer housing 16, with at least the blades of the fan 26 being captured between the guard 32 and the screened inlet opening 24 of the drum 18.

The separate drum drive motor 14 of the embodiment 10 of FIG. 1 drives an output shaft 34, which in turn causes the drum 18 to rotate when the drum drive motor 14 is in operation. A common switch may be used to simultaneously actuate and deactivate the fan motor 12 and drum drive motor 14, if so desired. In the case of the embodiment 10 of FIG. 1, the output shaft 34 has a drum belt pulley 36 at its distal end, with a drum drive belt 38 extending around the pulley 36 and around a circumferential groove 40 in the dryer drum 18.

The configuration of the ambient air clothes dryer 10, as well as the configurations of other embodiments disclosed herein, requires no heavy, stiff high voltage and/or high amperage electrical cable, as is universally required for the heating elements of conventional electric clothes dryers. Moreover, no gas line connection is required, as there is no use of a gas heater for the incoming air of the present dryer. Thus, the present dryer is relatively lightweight in comparison to conventional dryers with their heating systems, and requires no more power than is capable of being supplied by a conventional household electric cord. (In some embodiments, the motor(s) may be 12-volt DC, enabling them to be powered from a motor vehicle electrical system if so desired.) The light weight and simple power requirements of the present ambient air dryer allow it to be moved about readily to various locations as desired. Accordingly, external transport wheels 42 may be provided beneath one or both ends of the housing 16, with a pair of support legs 44 being shown beneath the opposite end of the housing 16 in the embodiment of FIG. 1. A handle 46 may be provided across one side of the housing shell 16, to facilitate lifting of that side for rolling the device 10 as desired by means of the wheels 42.

Figure 2:
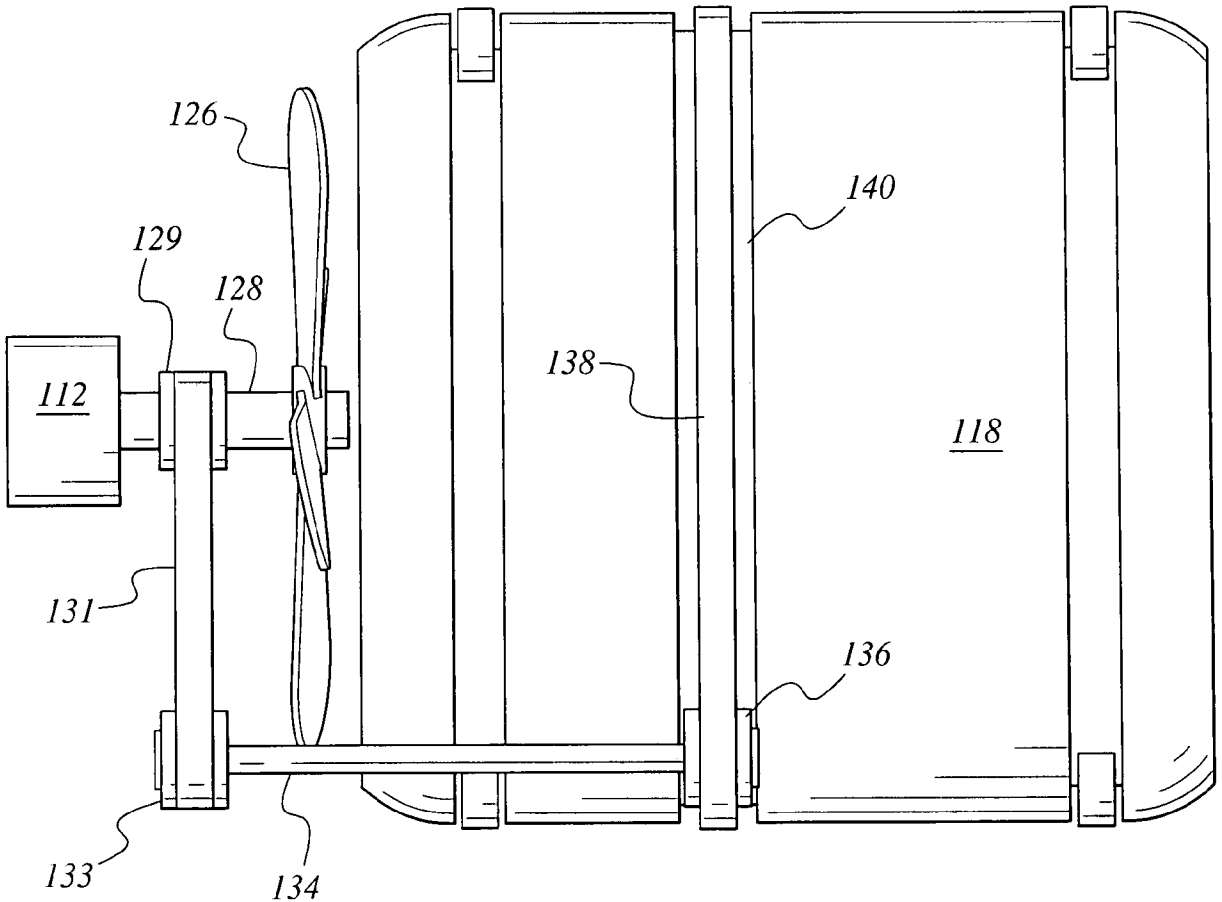
FIG. 2 is a simplified side elevation view of an alternative embodiment of the present dryer, illustrating an alternative drum drive system.

FIG. 2 provides a side elevation view of an alternative drum drive system, in which the fan drive is also used to rotate the drum. In FIG. 2, the fan motor 112 drives an output shaft 128 to which the fan 126 is connected, as in the corresponding components 12, 28, and 26 of the embodiment 10 of FIG. 1. However, the fan motor output shaft 128 may include a drive belt pulley 129 thereon, with a jackshaft drive belt 131 extending from the fan motor shaft pulley 129 to a driven pulley 133 on a radially offset jackshaft or drum drive shaft 134. The shaft 134 includes a drum drive belt pulley 136 at its distal end, with a drum drive belt 138 extending around the pulley 136 and riding in a circumferential groove 140 around the dryer drum 118. It will be seen that the dryer drum 118 and drum drive belt 138 may be identical to the corresponding components 18 and 38 illustrated in FIG. 1 and described further above. The distinction between the configuration of FIG. 1 and that of FIG. 2 is the use of a shaft and belt system driven from the concentric fan motor to rotate the dryer drum in the embodiment of FIG. 2.

Figure 3:
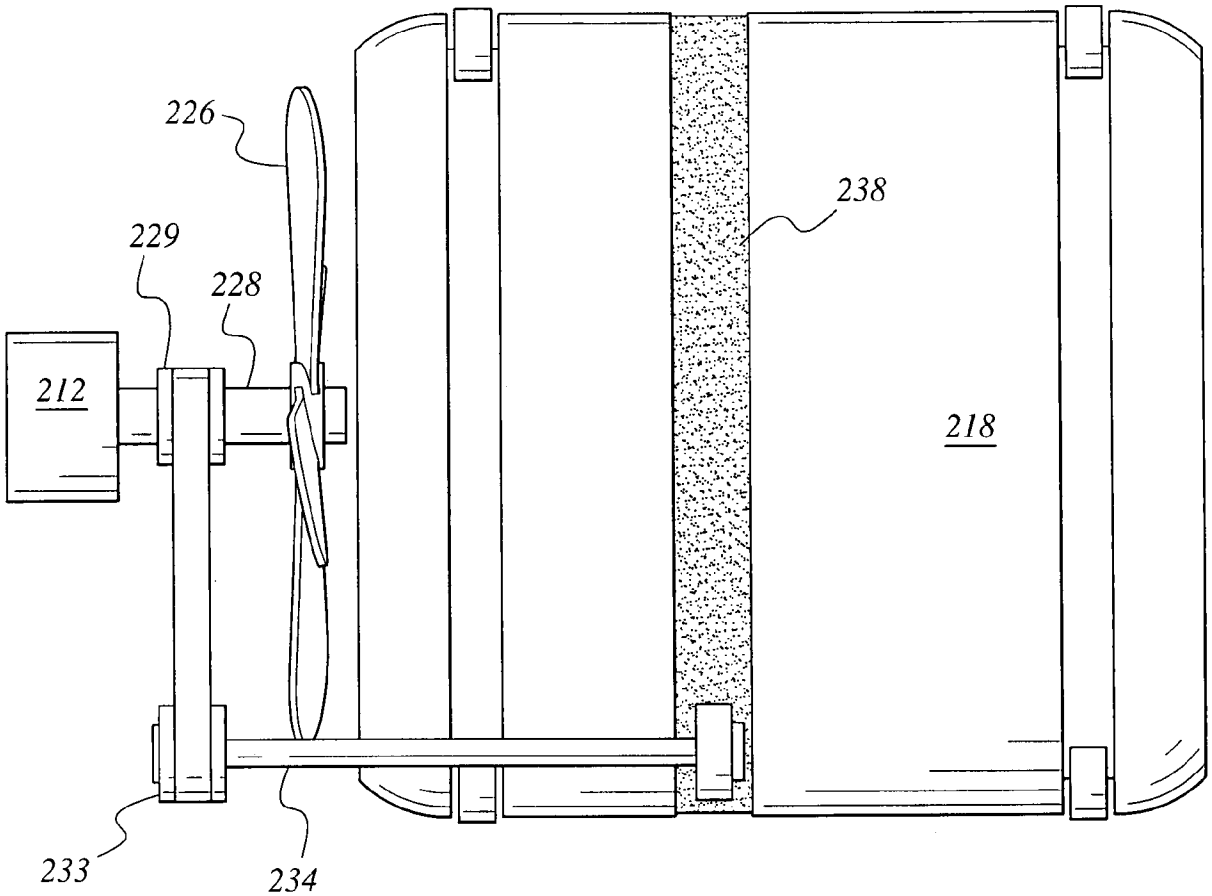
FIG. 3 is another simplified side elevation view showing another alternative embodiment of a drum drive system.

FIG. 3 provides a side elevation view of an embodiment similar to that of FIG. 2, differing in the means used to impart rotary motion directly to the drum. In FIG. 3, the fan motor 212 drives an output or fan drive shaft 228 and fan 226, with the shaft 228 having a drive belt pulley 229 thereon, just as in the case of the equivalent components 112, 128, 126, and 129 of the embodiment of FIG. 2. The pulley 229, in turn, drives a jackshaft or drum drive shaft 234 by means of a jackshaft driven pulley 233 on one end of the shaft 234, just as in the embodiment of FIG. 2. However, rather than driving the drum 218 by means of a belt extending around the drum, as shown in FIGS. 1 and 2, the jackshaft or drum drive shaft 234 has a friction wheel 236 (rubber-coated, etc.) at its distal end which bears against a circumferential friction band 238 surrounding the dryer drum 218. Rotation of the friction wheel 236 imparts rotational motion to the dryer drum 218 by means of the friction between the wheel 236 and friction band 238 around the drum. It will be seen that such a drum drive system may also be incorporated in the embodiment of FIG. 1, with the drum drive shaft 34 having a friction wheel 236 at the distal end thereof in lieu of the pulley 36 shown, and the dryer 10 incorporating the drum 218 of FIG. 3 with its friction band 238.

Figure 4:
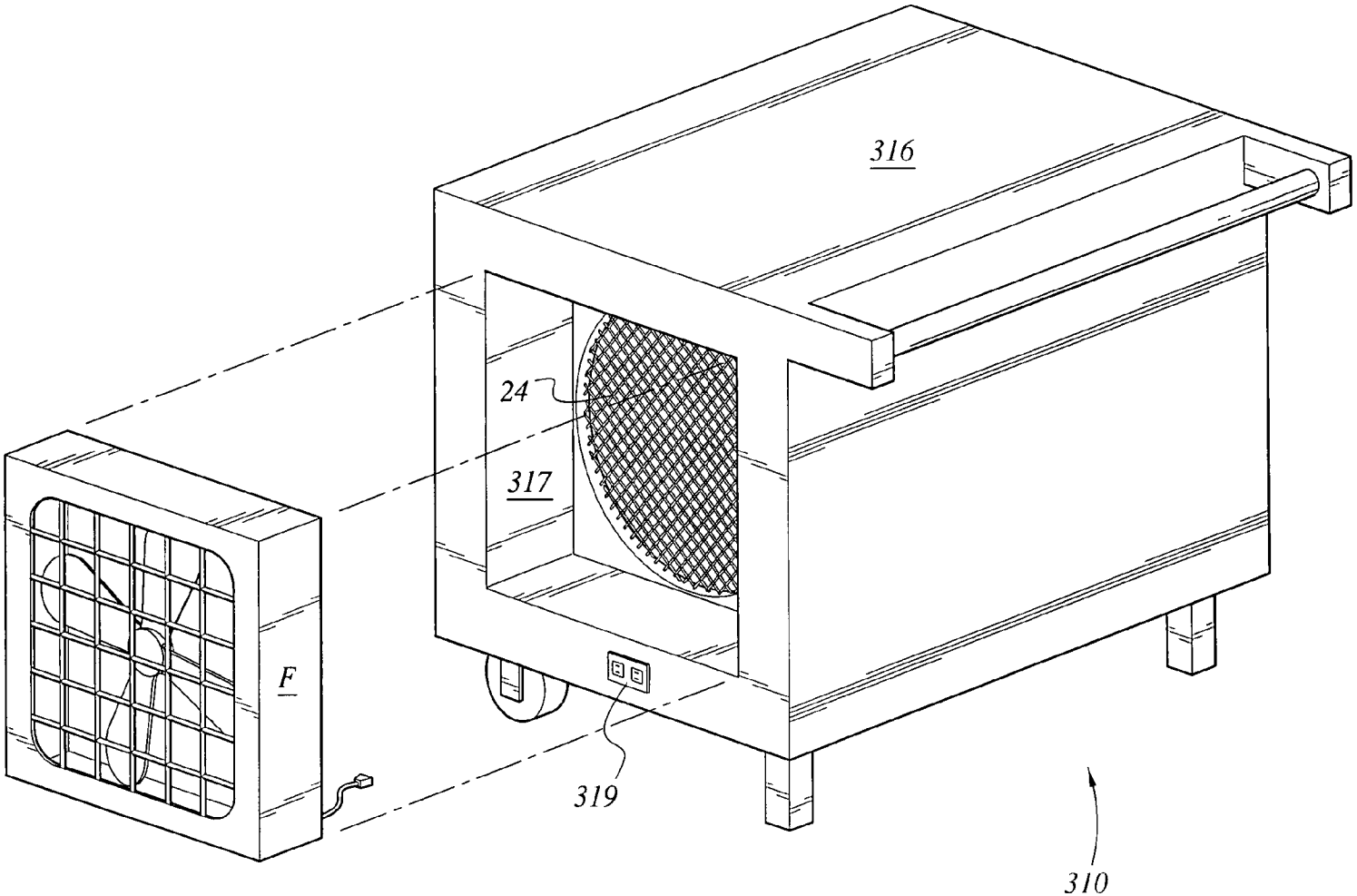
FIG. 4 is an exploded perspective view of yet another alternative embodiment of the present dryer, in which a separate portable box fan is used to provide airflow through the drum.

FIG. 4 provides an illustration of an additional embodiment of the present ambient air dryer, in which a portable fan is used to supply the air through the dryer drum. The dryer 310 of FIG. 4 includes a housing 316 which contains the drum 18 and drum drive mechanism comprising motor 14, drum drive shaft 34, shaft output pulley 36, and drum drive belt 38, just as in the embodiment illustrated fully in FIG. 1. However, rather than incorporating a fan integrally therewith, as in the embodiments of FIGS. 1 through 3, the housing 316 of the dryer 310 includes a fan receptacle 317 in the rear wall thereof, i.e., adjacent the screened air inlet end 24 of the drum. The fan receptacle 317 is configured to fit a conventional portable fan F, commonly known as a "box fan," therein. The fan receptacle 317 may be configured to accept other types of fans, as desired. A suitable electrical outlet 319 may be provided on the housing 316, allowing the fan F to be plugged in for operation. Power to the outlet 319 may be provided through appropriate control circuitry on or in the dryer housing or cabinet 316, as desired, to provide control of the fan F from the ambient air dryer controls.

Figure 5:
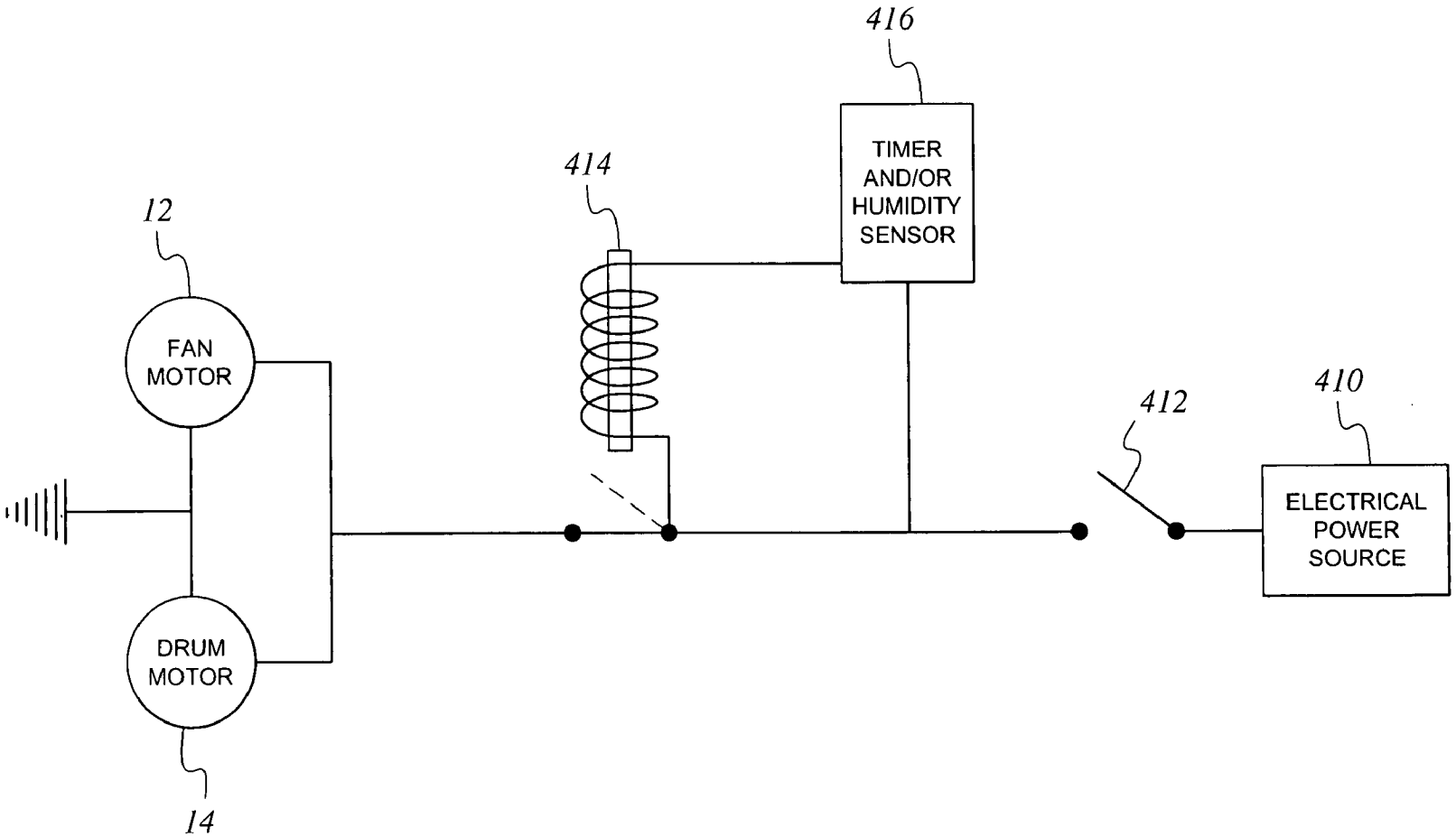
FIG. 5 is a simplified schematic diagram of an exemplary electrical and control system that may be incorporated with the present dryer.

FIG. 5 provides a basic electrical schematic diagram of circuitry that may be incorporated with the present ambient air clothes dryer in its various embodiments. In FIG. 5, a conventional electrical power source 410, e.g., 115-volt ac power from the power grid, or perhaps 12-volt dc power from an automotive or other electrical source when the ambient air dryer is manufactured to accept such power, provides electrical power to the dryer through a master switch 412. The master switch provides power to the fan motor, e.g., motor 12 of FIG. 1, and the drum drive motor, e.g., motor 14 of FIG. 1, through a solenoid or other appropriate switch 414. The switch 414 may incorporate the electrical outlet 319 for incorporation in the portable fan embodiment of FIG. 3, if so desired.

The solenoid switch 414 is not required in the simplest embodiments of the present ambient air dryer. However, the dryer in any of its embodiments may include a timer and/or humidity sensor 416, if so desired. These components are conventional in clothes and laundry dryers, and need not be described in detail herein. The timer may be incorporated in combination with a rotary on/off switch to serve the function of the master switch 412, if so desired. In any event, the timer and/or humidity sensor 416 is normally closed when electrical power is applied for operation of the dryer, with the electrical contacts opening when a predetermined time is reached (for the timer) or when the air flow from the dryer reaches a predetermined low level of humidity (for the humidity sensor). If either of these conditions occurs, power to the solenoid switch 414 is interrupted, thereby interrupting power to the fan and drum drive motors 12 and 14 and shutting off the dryer. The opening of the solenoid switch 414 may also trigger the operation of a buzzer, bell, or other audible or visual signaling means to alert the user of the dryer that the drying operation is complete, much as in the case of conventional clothes dryers. Where the circuit of FIG. 5 is incorporated with the portable fan embodiment of FIG. 4, the switch 414 may control power to the outlet 319 to shut off power to the outlet 319, thereby shutting off the fan F plugged into the outlet 319.

In conclusion, the present ambient air laundry and clothes dryer in its various embodiments provides a significant advance in efficiency for such machines, particularly in relatively warm and/or dry environments where the device may take advantage of the ambient air conditions.

It is to be understood that the present invention is not limited to the embodiments described above, but encompasses any and all embodiments within the scope of the following claims.

I claim:

1. An ambient air clothes dryer, comprising:

a housing;

a hollow rotating drum disposed within said housing, said drum comprising:

an impervious cylindrical wall defining a diameter;

a screened airflow inlet end having a diameter approaching the diameter of the cylindrical wall of said drum; and a screened airflow outlet end door opposite the inlet end, the door having a diameter approaching the diameter of the cylindrical wall of said drum;

a fan drive motor and fan drive shaft concentrically disposed at the inlet end of said drum;

a circular, rotary fan having a diameter substantially equal to the diameter of said drum, extending from the fan drive shaft and selectively blowing ambient air axially through said drum;

a drum drive motor having an output shaft selectively rotating said drum; and a drum drive wheel extending from the output shaft of said drum drive motor and frictionally rotating against the cylindrical wall of said drum.

2. The ambient air clothes dryer according to claim 1, further including external wheels depending from said housing.

3. The ambient air clothes dryer according to claim 1, further including a timer mechanism electrically communicating at least with said fan motor.

4. The ambient air clothes dryer according to claim 1, further including a humidity sensor electrically communicating at least with said fan motor.

* * * * *